US007505711B2

(12) United States Patent
Yoshimoto et al.

(10) Patent No.: US 7,505,711 B2
(45) Date of Patent: Mar. 17, 2009

(54) WASTE DEVELOPER COLLECTING DEVICE AND IMAGE FORMING APPARATUS PROVIDED THEREWITH

(75) Inventors: Yuhsuke Yoshimoto, Yamatotakada (JP); Yasuyuki Ishiguro, Higashiosaka (JP); Hiroshi Kubota, Kadoma (JP); Hiroshi Kawahito, Nara (JP); Jun Yamaguchi, Ikoma (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 368 days.

(21) Appl. No.: 11/250,539

(22) Filed: Oct. 17, 2005

(65) Prior Publication Data

US 2006/0083552 A1 Apr. 20, 2006

(30) Foreign Application Priority Data

Oct. 18, 2004 (JP) ..... 2004-303521

(51) Int. Cl.
*G03G 15/08* (2006.01)

(52) U.S. Cl. ..... 399/120; 399/257

(58) Field of Classification Search ..... 399/99, 399/120, 257, 264

See application file for complete search history.

(56) References Cited

U.S. PATENT DOCUMENTS 4,899,690 A * 2/1990 Hacknauer et al. ..... 399/257
5,109,254 A * 4/1992 Oka et al. ..... 399/257
5,384,629 A * 1/1995 Watanabe et al. ..... 399/120
5,432,592 A * 7/1995 Watanabe et al. ..... 399/120
5,479,247 A * 12/1995 Watanabe et al. ..... 399/120
5,541,714 A * 7/1996 Watanabe et al. ..... 399/120
2005/0220516 A1* 10/2005 Lee et al. ..... 399/360

FOREIGN PATENT DOCUMENTS

JP 1-71757 U 5/1989
JP 04166977 A * 6/1992
JP 6-83183 A 3/1994
JP 6-89061 A 3/1994
JP 2000276021 A * 10/2000
JP 2005-010185 A 1/2005

* cited by examiner

*Primary Examiner*—David M Gray
*Assistant Examiner*—Andrew V Do
(74) *Attorney, Agent, or Firm*—Birch, Stewart, Kolasch & Birch, LLP

(57) ABSTRACT

A waste developer collecting device ejects and collects a waste developer used in a developing unit employing a two-component developing system in which a developer that contains toner and carrier is used. The waste developer collecting device includes: an opening and closing section for opening and closing a developer ejection opening formed on a bottom portion of the developing unit; an opening operation prohibiting section for prohibiting the opening operation of the opening and closing section; a collecting container for collecting the developer ejected through the developer ejection opening; and a collecting container fixing section for fixing the collecting container at a position where the developer ejected from the developing unit is collected. The opening operation prohibiting section allows the opening operation of the opening and closing section when the collecting container is coupled to the collecting container fixing section.

8 Claims, 9 Drawing Sheets

WASTE DEVELOPER COLLECTING DEVICE AND IMAGE FORMING APPARATUS PROVIDED THEREWITH

This Nonprovisional application claims priority under 35 U.S.C. § 119(a) on Patent Application No. 303521/2004 filed in Japan on Oct. 18, 2004, the entire contents of which are hereby incorporated by reference.

FIELD OF THE INVENTION

The present invention relates to a waste developer collecting device for use in an image forming apparatus that visualizes an electrostatic latent image on the phototoreceptor with use of a powdery developer and according to the electrophotographic recording system or electrostatic recording system.

BACKGROUND OF THE INVENTION

With the movement toward smaller developing units in conventional image forming apparatuses, and particularly in image forming apparatuses employing the tandem mode as in color copying machines, it has been difficult to automatically eject the developer. As such, in conventional image forming apparatuses of the tandem mode, the developer is replaced by first removing the developing unit from the main body and then rotating the coupling with the ejection opening facing downward, the coupling being rotated either manually or by rotating the developing unit outside the main body, as disclosed, for example, in Laid-Open Japanese Utility Model Publication No. 71757/1989 (Jitsukaihei 1-71757; Published on May 15, 1989).

Further, as disclosed in Japanese Laid-Open Patent Publication No. 89061/1994 (Tokukaihei 6-89061; published on Mar. 29, 1994), there has been proposed an automatic ejection technique. However, owning to the fact that an apparatus employing such an automatic ejection technique includes a large developing unit such as a large-sized high-speed machine, automatic ejection of the developer is performed by providing an ejection roller in addition to the stirring roller.

In an image forming apparatus employing the two-component development system, the developer is reused by first ejecting the finished developer from the developing unit and then replenishing the developing unit with a new developer. Here, care must be taken to strictly follow the proper procedure of replenishing the developer, or not to eject the developer before the developer is ready to be collected, because failure to do so results in contamination of the apparatus and its surroundings.

SUMMARY OF THE INVENTION

An object of the present invention is to provide a waste developer collecting device, realized by a simple mechanism and offering good operability, for reliably preventing a user from erroneously operating the device.

In order to achieve the foregoing object, the present invention provides a waste developer collecting device for ejecting and collecting a waste developer used in a developing unit employing a two-component developing system in which a developer that contains toner and carrier is used, the waste developer collecting device including: an opening and closing section for opening and closing a developer ejection opening formed on a bottom portion of the developing unit; an opening operation prohibiting section for prohibiting the opening operation of the opening and closing section; a collecting container for collecting the developer ejected through the developer ejection opening; and a collecting container fixing section for fixing the collecting container at a position where the developer ejected from the developing unit is collected, the opening operation prohibiting section allowing the opening operation of the opening and closing section when the collecting container is fixed by the collecting container fixing section.

According to this arrangement, the opening operation prohibiting section releases the opening operation of the opening and closing section when the collecting container fixing section fixes the collecting container. This enables the opening and closing section to open the developer ejection opening. The opening and closing section may be a board for example, and may be manually opened or closed by a user. With the opening operation of the opening and closing section released and the developer ejection opening opened, the waste developer is ejected out of the developing unit and collected in the collecting container.

Since the developer ejection opening cannot be opened unless the collecting container is fixed on the collecting container fixing section, there will be no spilled developer, which occurs when the developer ejection opening is opened before the collecting container is ready to collect the developer. Further, since the developer is collected by ejecting it through the developer ejection opening with the collecting container fixed on the collecting container fixing section, the waste developer can be collected for replacement without removing the developing unit from the image forming apparatus or other apparatuses in which the developing unit is installed.

Additional objects, features, and strengths of the present invention will be made clear by the description below. Further, the advantages of the present invention will be evident from the following explanation in reference to the drawings.

DETAILED DESCRIPTION OF THE INVENTION

Referring to FIG. 1 through FIG. 9, the following will describe one embodiment of the present invention.

Figure 2:
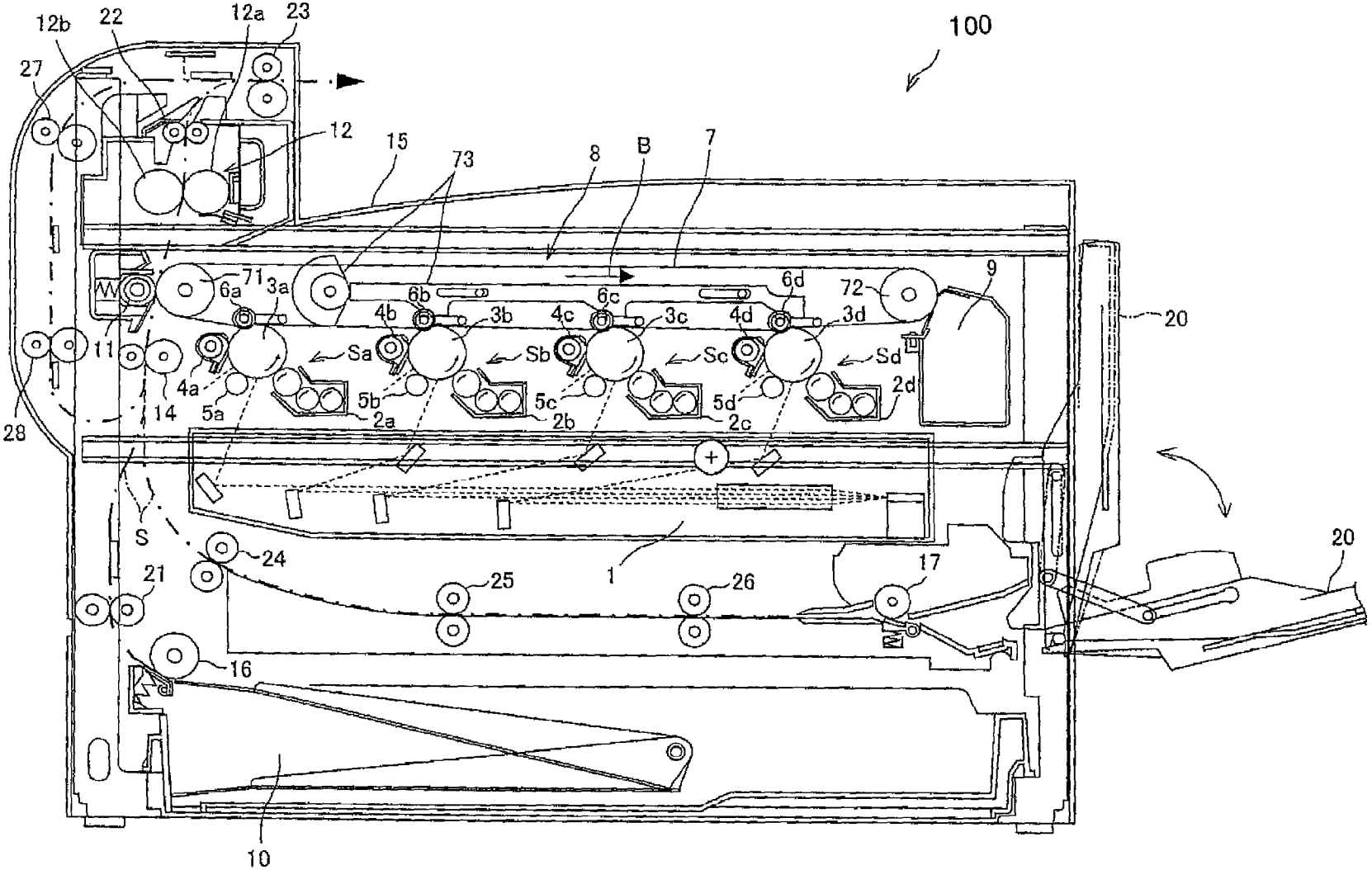
FIG. 2 is a cross sectional plan view illustrating a structure of an image forming apparatus provided with a developing unit equipped with the waste developer collecting device.

FIG. 2 schematizes an example of an image forming apparatus of the present invention.

An image forming apparatus 100 shown in FIG. 2 operates according to a color tandem system, in which chromatic or monochromatic images are formed on recording paper (sheet) according to externally supplied image data. The image forming apparatus 100 includes an exposure unit 1, developing units 2*a* through 2*d*, photoreceptor drums 3*a* through 3*d*, chargers 5*a* through 5*d*, cleaner units 4*a* through 4*d*, an intermediate transfer belt 7, an intermediate transfer belt unit 8, a fixing unit 12, a sheet transport path S, a feeding tray 10, and an ejection tray 15, among others.

The image data processed in the image forming apparatus 100 carries a color image of black (K), cyan (C), magenta (M), and yellow (Y). As such, as shown in FIG. 2, the developing units 2*a* through 2*d*, the photoreceptor drums 3*a* through 3*d*, the chargers 5*a* through 5*d*, and the cleaner units 4*a* through 4*d* are provided to form four kinds of latent images respectively corresponding to K, C, M, and Y. With these members, four imaging stations Sa, Sb, Sc, and Sd are formed, respectively corresponding to the colors of K, C, M, and Y. Note that, the affixes "a", "b", "c", and "d" in the reference numerals correspond to black, cyan, magenta, and yellow, respectively. The structures of the imaging stations Sa through Sd are essentially the same.

The photoreceptor drums 3*a* through 3*d* are disposed in an upper portion of the image forming apparatus 100.

The chargers 5*a* through 5*d* are charging means for uniformly charging the surfaces of the photoreceptor drums 3*a* through 3*d* to a predetermined potential. Further, the chargers 5*a* through 5*d* employ a roller charging system, in which semiconducting rubber rollers rotate the photoreceptor drums 3*a* through 3*d* in contact therewith. In this example, the charger 5*a* is provided in the imaging station Sa for black (K). The chargers 5*b*, 5*c*, and 5*d* are provided in the imaging stations Sb, Sc, and Sd for cyan (C), magenta (M), and yellow (Y), respectively.

The chargers 5*a* through 5*d* of the respective colors (K), (C), (M), and (Y) have the same dimensions, with a case width of 14 mm. Further, the chargers 5*a* through 5*d* all have the same specifications so that they can be used in other models having different processing speeds.

The charger 5*a* provided in the black imaging station Sa is supplied with high-voltage power from an individually provided high-voltage power supply. The ON/OFF of the high-voltage output from the high-voltage power supply to the charger 5*a* is controlled by low-voltage primary switching of the high-voltage power supply (not shown).

The chargers 5*a* 5*d* may be contact chargers employing rollers or brushes, or corona chargers of, for example, a scorotron type.

The exposure unit 1 serves to expose the charged surfaces of the photoreceptor drums 3*a* through 3*d* according to the input image data, so as to form corresponding electrostatic latent images on the surfaces of the photoreceptors 3*a* through 3*d*. The exposure unit 1 includes a laser scanning unit (LSU) equipped with a laser irradiating section and a reflecting mirror, for example, an EL or LED writing head in which light emitting diodes are disposed in an array.

The developing units 2*a* through 2*d* are provided to visualize the electrostatic latent images formed on the surfaces of the photoreceptor drums 3*a* through 3*d*, using toners of K, C, M, and Y. After development and image transfer, the cleaner units 4*a* through 4*d* remove and collect remaining toner on the surfaces of the photoreceptor drums 3*a* through 3*d*.

The intermediate belt unit 8 is provided above the photoreceptor drums 3*a* through 3*d*, and includes intermediate transfer rollers 6*a* through 6*d*, the intermediate transfer belt 7, an intermediate transfer belt driving roller 71, an intermediate transfer belt driven roller 72, an intermediate transfer belt tension mechanism 73, and an intermediate transfer belt cleaning unit 9. The intermediate transfer rollers 6*a* through 6*d*, the intermediate transfer belt driving roller 71, the intermediate transfer belt driven roller 72, and the intermediate transfer belt tension mechanism 73, along with other members, serve to suspend the intermediate transfer belt 7 and causes the intermediate transfer belt 7 to rotate in the direction of arrow B.

The intermediate transfer rollers 6*a* through 6*d* are ratably supported on the intermediate transfer roller mounts (not shown) of the intermediate transfer belt tension mechanism 73 in the transfer belt unit 8. The intermediate transfer rollers 6*a* through 6*d* provide a transfer bias for transferring the toner images, formed on the photoreceptor drums 3*a* through 3*d*, onto the intermediate transfer belt 7.

The intermediate transfer belt 7 is provided in contact with the photoreceptor drums 3*a* through 3*d*. The toner images of the respective colors formed on the photoreceptor drums 3*a* through 3*d* are successively overlaid on the intermediate transfer belt 7, so as to form a color toner image (chromatic toner image) on the intermediate transfer belt 7. The intermediate transfer belt 7 is an endless film of about 100 μm to 150 μm thick. Note that, in printing monochromatic images, only the photoreceptor drum 3*a* of black (K) is brought into contact with the intermediate transfer belt 7.

The transfer of toner images from the photoreceptor drums 3*a* through 3*d* onto the intermediate transfer belt 7 is performed by the intermediate transfer rollers 6*a* through 6*d* that are in contact with the rear surface of the intermediate transfer belt 7. For the transfer of toner images, a high-voltage transfer bias (high-voltage of the opposite polarity (+) to the charged toner (−)) is applied to each of the intermediate transfer rollers 6*a* through 6*d*.

The intermediate transfer rollers 6*a* through 6*d* each have a metal base (stainless steel), 8 mm to 10 mm in axis diameter, whose surface is coated with a conductive elastic member (for example, EPDM, urethane foam, etc.). With the conductive elastic member, a uniform high-voltage can be applied to the intermediate transfer belt 7. It should be noted here that, although the intermediate transfer rollers 6*a* through 6*d* are used as transfer electrodes in this example, the transfer electrodes may be realized, for example, by brushes as well.

In the manner described above, the electrostatic latent images of the respective color phases formed on the photoreceptor drums 3*a* through 3*d* overlaid on the intermediate transfer belt 7 to reproduce the image information supplied to the image forming apparatus. By the rotation of the intermediate transfer belt 7, the overlaid electrostatic image is transferred onto recording paper, with the transfer roller 11 in contact with the intermediate transfer belt 7 via the recording paper.

Here, the intermediate transfer belt 7 and the transfer roller 11 are pressed against each other with a predetermined nip, and the transfer roller 11 is applied with a voltage for transferring toner onto the recording paper (high-voltage of the opposite polarity (+) to the charged toner (−)). Further, in order to provide a constant nip for the transfer roller 11, it is preferable that one of the transfer roller 11 and the intermediate transfer belt driving roller 71 be made of a hard material (for example, metal) while the other is a soft elastic roller (for example, elastic rubber roller, foamed resin roller).

The toner adhered to the intermediate transfer belt 7 from the photoreceptor drums 3*a* through 3*d*, or toner that was not transferred to the recording paper by the transfer roller 11 and remaining on the intermediate transfer belt 7 causes mixing of colors in the next step. In order to avoid this problem, such toner is removed and collected by the intermediate transfer belt cleaning unit 9, as mentioned above.

The intermediate transfer belt cleaning unit 9 includes a member in contact with the intermediate transfer belt 7. An example of such a member is a cleaning blade provided as a cleaning member. The intermediate transfer belt 7 in contact with the cleaning blade is supported by the intermediate transfer belt driven roller 72 from its bottom surface.

The feeding tray 10 stores recording paper (recording sheets) used for image formation, and is disposed underneath the exposure unit 1 of the image forming apparatus 100. The ejection tray 15, provided on an upper portion of the exposure unit 100, is where printed recording paper is stacked face down. On a side wall of the image forming apparatus 100, a manual feeding tray 200 is provided. The manual feeding tray 200 is foldable, and is provided to manually feed recording paper from the side of the image forming apparatus 100.

The sheet transport path S of the image forming apparatus 100 is substantially vertical, and is provided to transport the recording paper from the feeding tray 10 to the ejection tray 15 via the transfer section 11 and the fixing unit 12. In the vicinity of the sheet transport path S connecting the feeding tray 10 and the manual feeding tray 200 to the ejection tray 15, there are provided pickup rollers 16, 17, a registration roller 14, the transfer roller 11, the fixing unit 12, and transport rollers 21 through 28 for transporting the recording paper.

The transport rollers 21 through 26 are small rollers disposed along the sheet transport path S to facilitate and assist transport of the recording paper. The transport rollers 27 and 28 are provided to reverse the recorded surface of the recording paper in double-sided copying, in which the recording paper is transported to the registration roller 14 through a reversed ejection sheet path of the sheet transport path S along the fixing unit 12.

The pickup roller 16 is provided on the both sides at the pickup end of the feeding tray 10. The pickup roller 17 is provided on the both sides at the pickup end of the manual feeding tray 20. With the pickup roller 16, the recording paper is supplied from the feeding tray 10 to the sheet transport path S, one at a time. With the pickup roller 17, the recording paper is supplied from the manual feeding tray 20 to the sheet transport path S, one at a time.

The registration roller 14 suspends a supply of the recording paper being transported in the sheet transport path S. With the registration roller 14, the recording paper is transported to the transfer roller 11 at such a timing that the tip of the toner image formed on the intermediate transfer belt 7 meets the tip of the recording paper.

The fixing unit 12 includes a heat roller 12a and a pressure roller 12*b*, among others. The heat roller 12*a* and the pressure roller 12*b* rotate with the recording paper sandwiched in between.

Under the control of a signal from a temperature detector (not shown), the heat roller 12*a* is set to a predetermined fixing temperature. With the pressure roller 12*b*, the heat roller 12*a* applies heat and pressure to the recording paper so as to fuse, mix, and press the chromatic toner image which has been transferred to the recording paper, with the result that the toner image is fixed on the recording paper under applied heat.

The recording paper with the fixed chromatic toner image is transported to the reversed ejection sheet path of the sheet transport path S with the transport rollers 22 and 23, so that the recording paper is ejected onto the ejection tray 15 by being reversed (with the chromatic toner image facing down).

The following will describe a waste developer collecting device according to the present invention.

First, description is made as to a structure of the waster developer collecting device.

Figure 3:
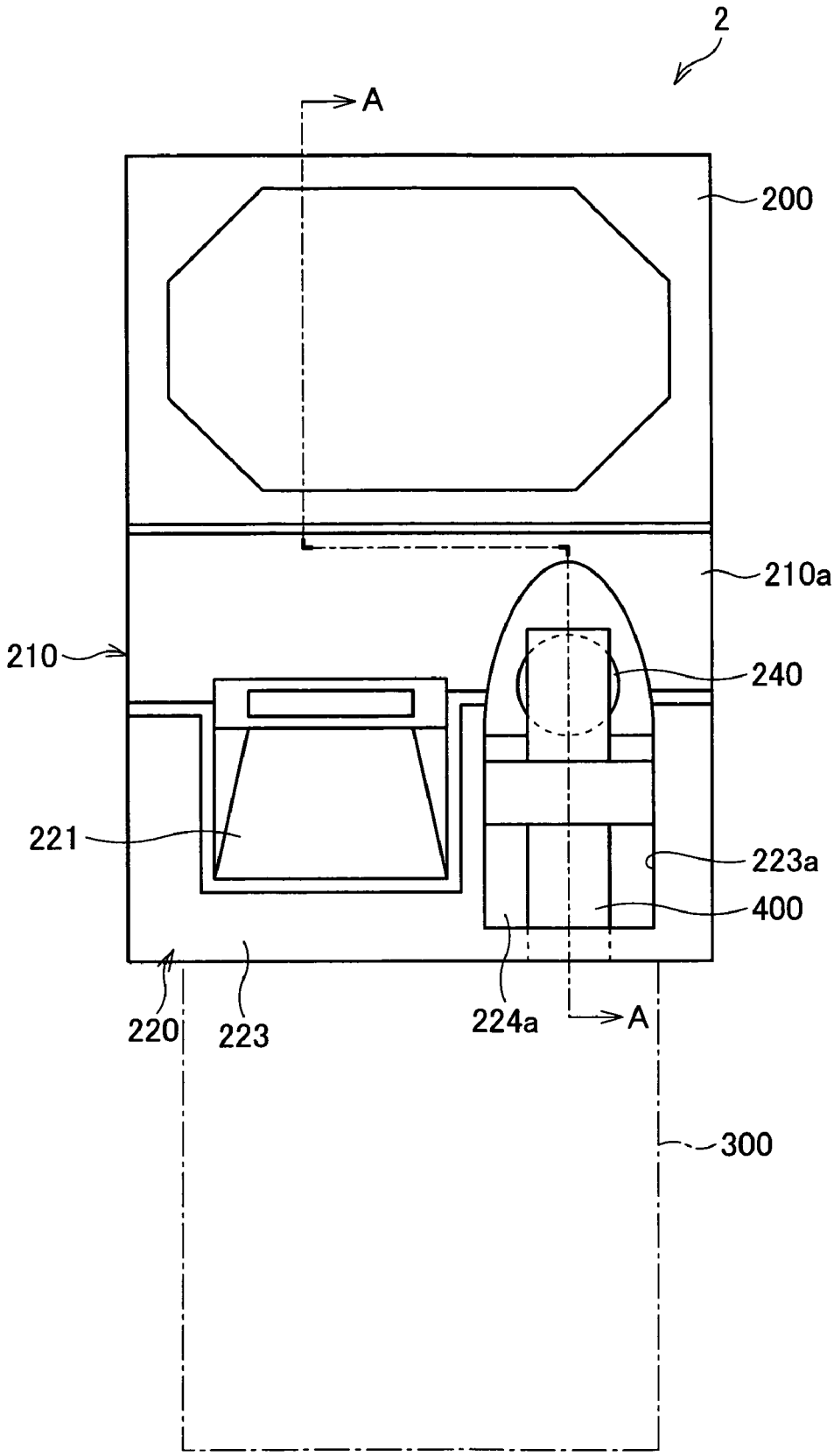
FIG. 3 is a plan view illustrating an external structure of the developing unit.
Figure 4:
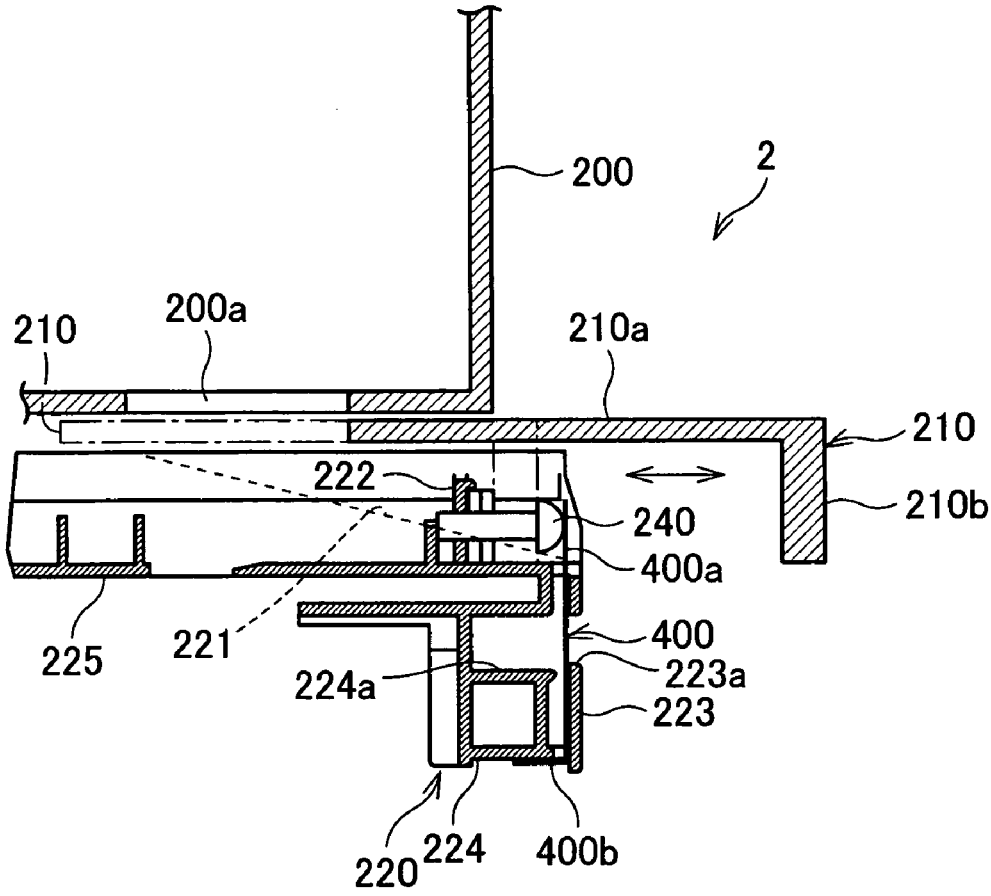
FIG. 4 is a cross sectional side view illustrating a structure on the developing unit side of the waste developer collecting apparatus.

The waste developer collecting device is structured to include part of the developing unit 2 (in the following, the developing units 2*a* through 2*d* will be collectively referred to as "developing unit 2"), and a collecting container 300 as illustrated in FIG. 3 and FIG. 4.

FIG. 3 is a plan view illustrating an external structure of the developing unit 2. In FIG. 3, the developing unit 2 is shown as viewed from the front surface. As used herein, the "front surface" refers to the operating plane of the image forming apparatus 100 facing a user, and it includes a door that can be opened at the time of maintenance procedure, for example. FIG. 4 is a cross sectional view taken along the line A-A of FIG. 3.

As illustrated in FIG. 3 and FIG. 4, an ejection opening shutter 210 and a collecting container mount 220 are provided at a lower part of a main body 200 of the developing unit 2.

The ejection opening shutter 210 is provided as opening/closing means, and includes a horizontal portion 210*a* and a front face portion 210*b*. The ejection opening shutter 210 can slide along the directions of arrow shown in FIG. 4.

The horizontal portion 210*a* is a board that extends horizontally. Under normal operating conditions of the developing unit 2 (when operating the image forming apparatus 100), the horizontal portion 210*a* is positioned to seal a developer ejection opening 200*a* provided through the bottom surface of the main body 200, as indicated by the dashed line in FIG. 4, thereby preventing leakage of the developer. The developer ejection opening 200*a* is provided in the anterior part on the bottom of the developing unit 2. With the developer ejection opening 200*a* provided close to the installation position of the collecting container 300 to be described later, a larger angle can be provided for an ejection slope 221 (described later), making it easier to eject the developer. Behind the developer ejection opening 200*a* (posterior part of the developing unit 2), there is provided a toner supply opening (not shown).

The front surface portion 210*b* is provided along the front surface of the developing unit 2, extending vertically downward from the horizontal portion 210*a*. The front surface portion 210*b* is positioned slightly above an opening 223*a* of an opening wall portion 223, without covering the opening 223*a*.

The collecting container mount 220, provided as collecting container fixing means, is disposed underneath the horizontal portion 210*a* to constitute part of the developing unit 2. The collecting container mount 220 includes the ejection slope 221, an ejection opening shutter retaining section 222, the front surface wall portion 223, a collecting container retaining section 224, and a base portion 225.

The base portion 225 is provided parallel to the bottom surface of the developing unit 2, without touching the horizontal part 210*a* or the bottom surface of the developing unit 2. Though not shown, the base portion 225 is fixed on the developing unit 2.

The ejection slope 221 is provided above the base portion 225. The ejection slope 221 slants from the posterior end of the developer ejection opening 200*a* towards the front side of the collecting container mount 220, channeling the ejected waste toner from the developer ejection opening 200*a* to the outside of the developing unit 2. With the developer ejection opening 200*a* closed by the ejection opening shutter 210 (as indicated by the dashed line), the opening end portion (anterior side) of the ejection slope 221 is covered by the front surface portion 210*b*.

The ejection opening shutter retaining section 222 is provided on the base portion 225, and has a hole (not shown)

fitted with a fixing screw 240 provided as fixing means. The fixing screw 240 is fitted with the ejection opening shutter retaining section 222 with its head pressed against the front surface portion 210*b*. As a result, the ejection opening shutter 210 is fixed and retained on the collecting container mount 220, with the developer ejection opening 200*a* closed by the ejection opening shutter 210.

The front wall portion 223 is provided slightly below the opening end portion of the ejection slope 221. The front wall portion 223 includes an opening 223*a* next to the opening end portion of the ejection slope 221. The opening 223*a* is provided to accept a front end portion 302*a* of a tongue 302 of the collecting container 300 (see FIG. 6, FIG. 7) as will be described later. With the opening 223*a* and the opening end portion of the ejection slope 221 disposed close to one another, the lower portion of the collecting container mount 220 can be reduced in size.

The collecting container retaining section 224 is provided below the base portion 225 with a predetermined distance (gap) from the front wall portion 223. The collecting container retaining section 224 has a depression 224*a* corresponding in position to the opening 223*a*.

Figure 5:
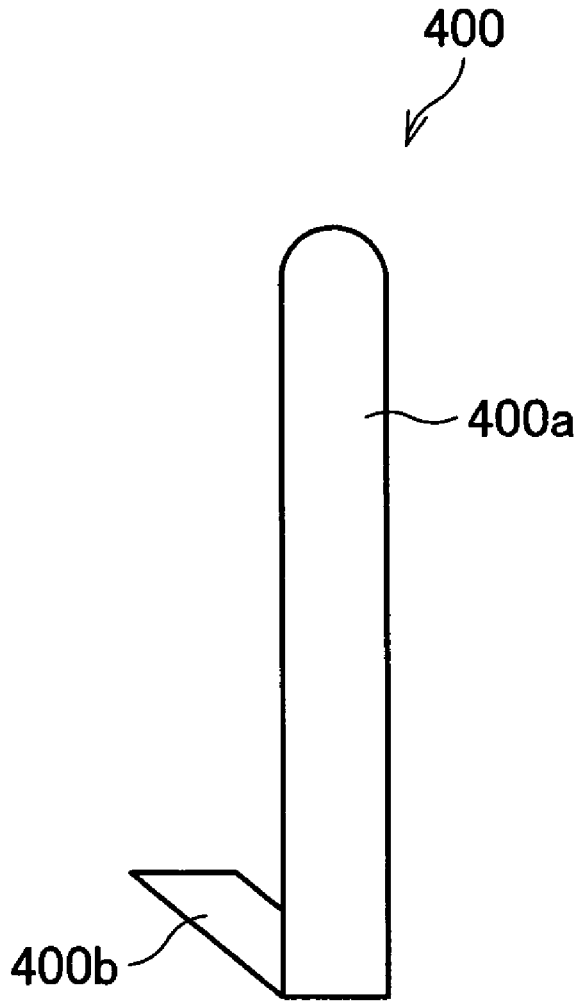
FIG. 5 is a perspective view illustrating a structure of a screw blocking member provided on the developer unit side of the waste developer collecting device.

In the gap between the front wall portion 223 and the collecting container retaining section 224 and behind the opening 223*a*, a screw blocking member 400 is inserted. The screw blocking member 400, which is provided as fixing releasing/non-releasing means, includes a main body 400*a* and a fixing portion 400*b* that extends straight from a lower end of the main body 400*a*, as shown in FIG. 5. The screw blocking member 400 is positioned so that the main portion 400*a*, with its straight shape, covers the head of the fixing screw 240 with its upper end portion. The main portion 400*a* is also exposed through the opening 223*a* of the front wall portion 223. In this way, the screw blocking member 400 blocks the head of the fixing screw 240 when the tongue 302 is not coupled to the opening 223*a*. The fixing portion 400*b* is fixed on the bottom surface of the collecting container retaining section 224. The screw blocking member 400, provided as a flexible member, is preferably made of a flexible material such as a polyethylene terephthalate film (for example, Mylar™ film, the Du Pont product) with a sufficiently thin thickness (for example, a film with a thickness of about 0.1 mm to 0.3 mm), so that it can easily deform under external force.

Figure 6:
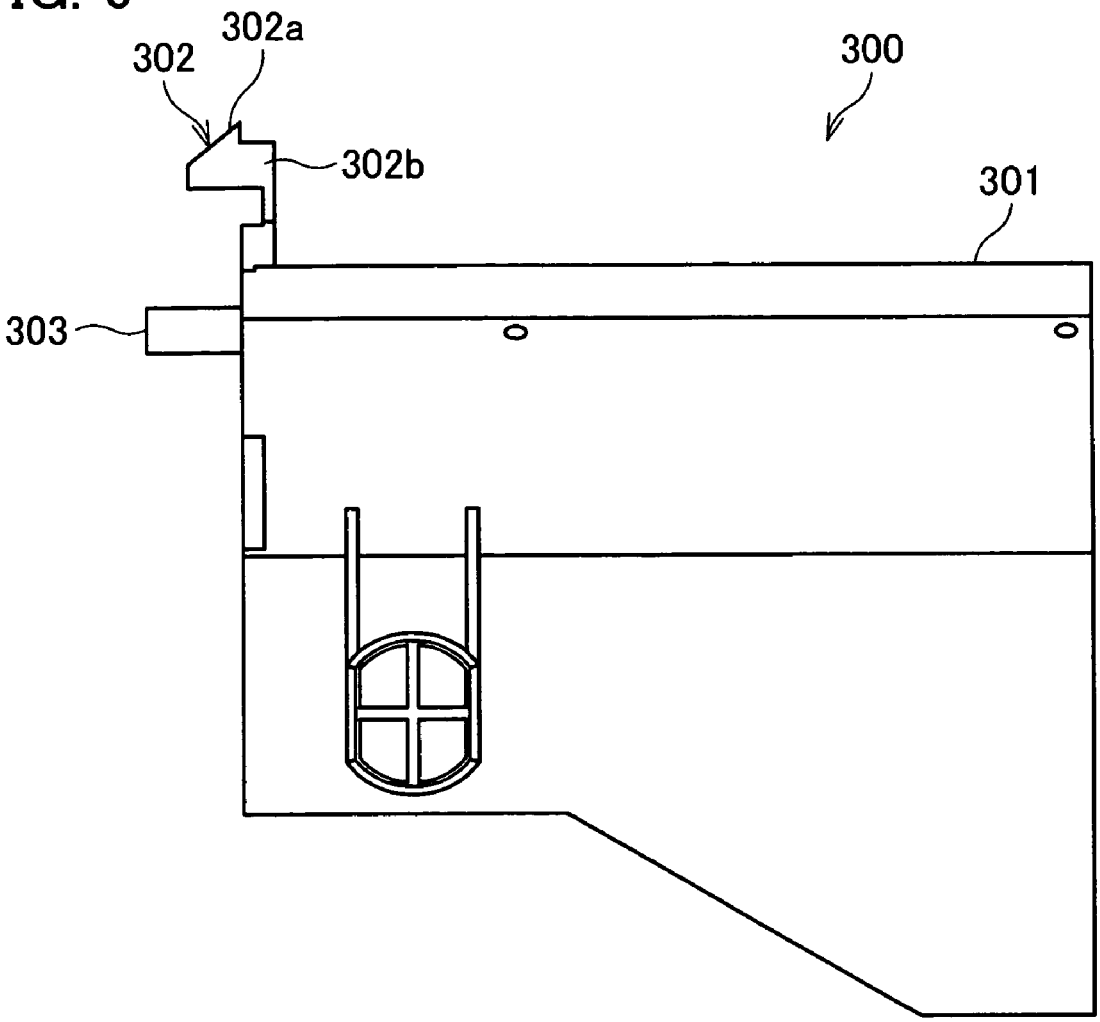
FIG. 6 is a side view illustrating a structure of a collecting container in the waste developer collecting device.
Figure 7:
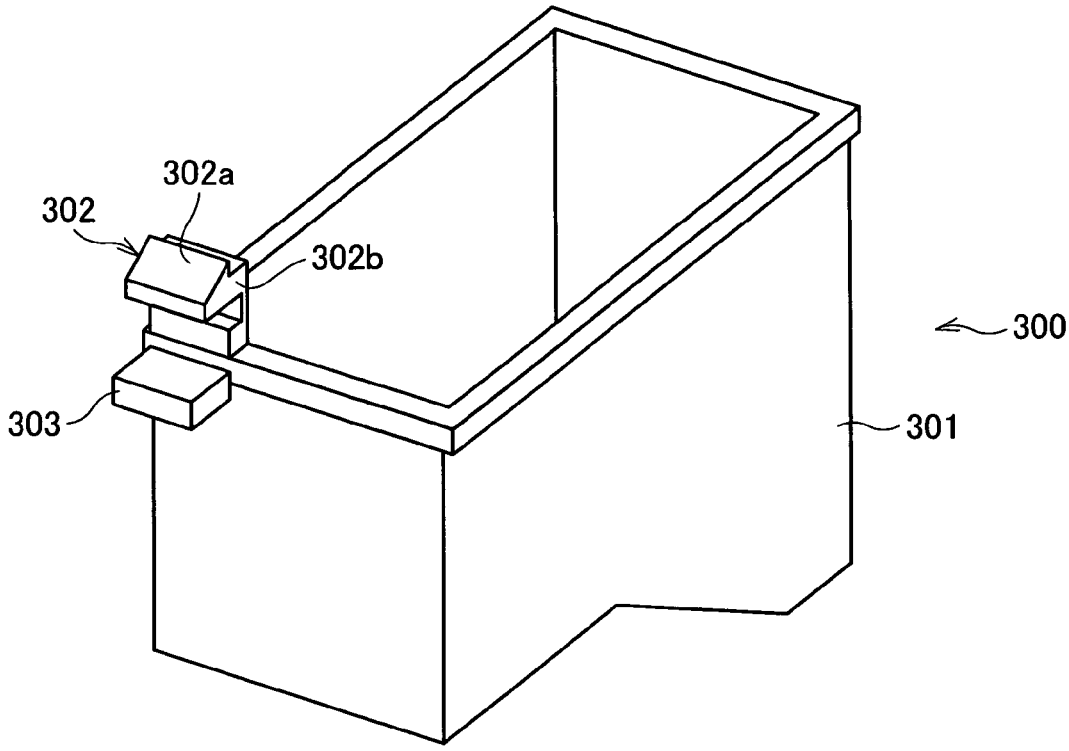
FIG. 7 is a perspective view illustrating a structure of the collecting container.

FIG. 6 is a side view illustrating a structure of the collecting container 300, and FIG. 7 is a perspective view illustrating a structure of the collecting container 300.

As shown in FIG. 6 and FIG. 7, the collecting container 300 includes a box-shaped container main body 301 having no ceiling, where waste toner is stored. The container main body 301 includes the tongue 302 and a contact portion 303 on the upper end portion of the surface to be attached to the collecting container mount 220.

The tongue 302 is provided as a container-side coupling portion by including a tip portion 302*a* and a support portion 302*b*. The tip portion 302*a* is so formed that, with the collecting container 300 attached and fixed on the collecting container mount 220 beneath the developing unit 2 as shown in FIG. 3, the tip portion 302*a* stops on, or is coupled to, the opening 223*a* provided as a fixing-side coupling portion, and that the waste toner ejected through the ejection slope 221 can pass by. Further, the tip portion 302*a* is shaped so that its upper end portion has a projection, serving as a hook, which stops on the periphery of the opening 223*a* on the inner side of the front wall portion 223. Further, the front portion of the tip portion 302*a* is slanted for easy insertion into the opening 223*a*. The tongue 302 is flexible enough to allow for easy insertion and removal of the tip portion 302*a* to and from the opening 223*a* but strong enough to sufficiently hold the collecting container 300.

The support portion 302*b* has a horizontal portion that extends horizontally from the tip portion 302*a*, and a vertical portion that extends downward from the horizontal portion. The horizontal portion is sized to have a cross sectional shape that can fit the opening 223*a*.

With such a configuration, the tongue 302 serves to push the screw blocking member 400 into the depression 224*a*, and fix and hold the collecting container 300 on the collecting container mount 220. This improves ease of installation in attaching the collecting container 300 to the main body of the image forming apparatus 100, and prevents the collecting container 300 from detaching from the main body of the image forming apparatus 100 due to its dead weight or the weight of the developer.

The contact portion 303 is provided slightly below the lower end portion of the tongue 302. The contact portion 303 is rectangular in shape and projects in the same direction as the tip portion 302*a* of the tongue 302 inserted into the opening 223*a*. Further, as shown in FIG. 1, the contact portion 303 is positioned such that it is in contact with the bottom surface of the collecting container retaining section 224 when the tongue 302 is inserted in the depression 224*a*.

In the following, description is made as to the processes of ejecting and collecting waste toner by the waste toner collecting device. FIG. 1 is a cross sectional view illustrating a state in which the collecting container 300 is attached to the developing unit 2.

First, in order to eject the waste toner, the collecting container 300 is attached to the developing unit 2 of the described structure assembled in the image forming apparatus 100.

Figure 1:
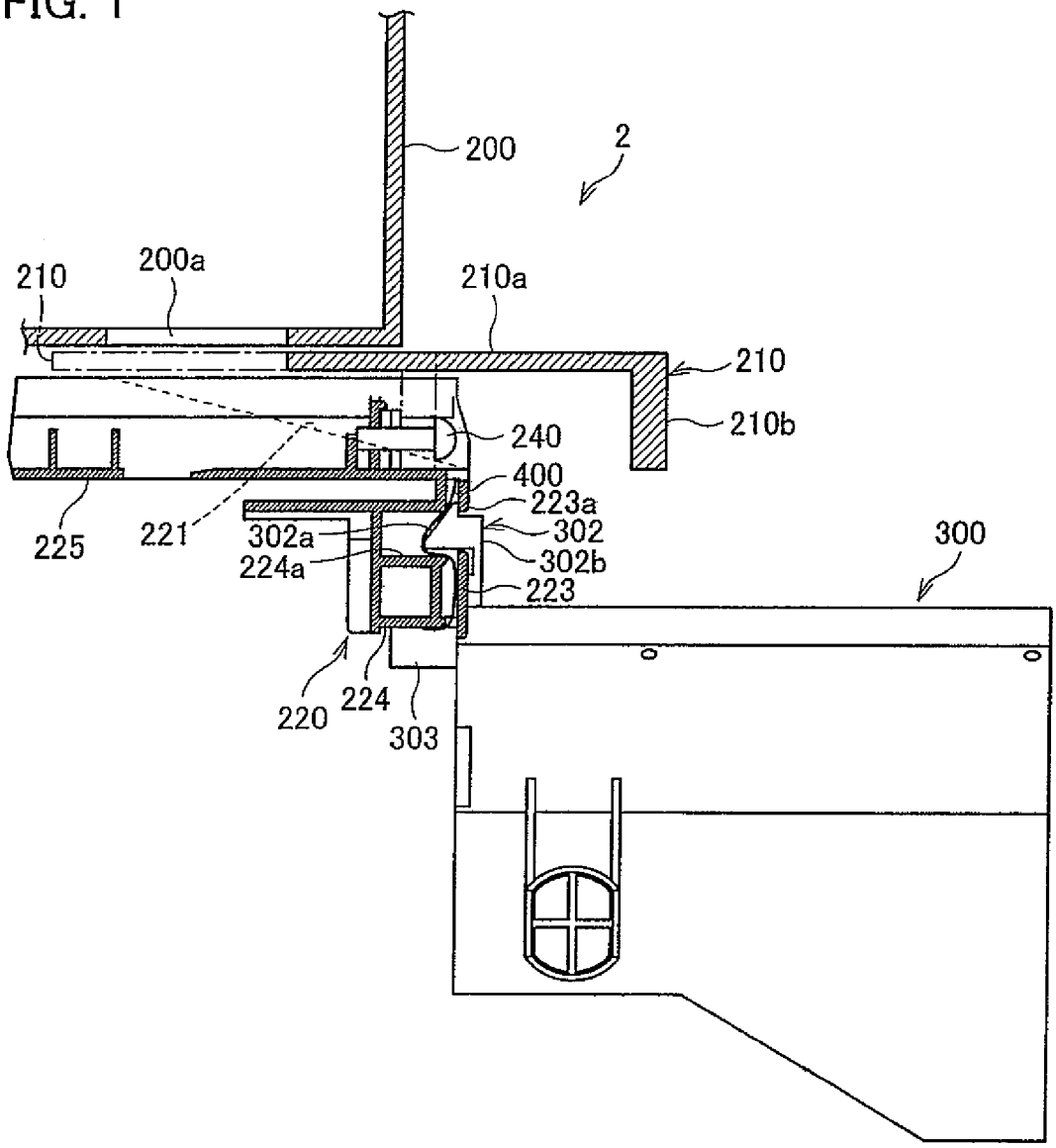
FIG. 1 is a partial cross sectional side view illustrating a structure of a waste developer collecting device according to one embodiment of the present invention.

As illustrated in FIG. 1, in order to attach the collecting container 300, the tip portion 302*a* of the tongue 302 is inserted in the depression 224*a* through the opening 223*a*. Here, the upper end portion of the tip portion 302 stops on the periphery of the opening 223*a* on the inner surface of the front wall portion 223, and the lower surface of the horizontal portion of the support portion 302*b* is brought into contact with the upper edge of the opening 223*a* of the front wall portion 223, with the result that the tongue 302 is fixed and held on (coupled to) the front wall portion 223. With the tongue 302 fixed and held in this manner, the contact portion 303 is in contact with the bottom surface of the collecting container retaining section 224.

With the tongue 302 and the contact portion 303 sandwiching the collecting container retaining section 224, the collecting container 300 is fixed and held by the collecting container retaining section 224. Here, the tip portion 302*a* pushes the screw blocking member 400 into the depression 224*a*. This lowers the upper portion of the screw blocking member 400, exposing the head of the fixing screw 240.

Next, the fixing screw 240 is unscrewed to free the movement of the ejection shutter 210. The ejection shutter 210 is then slid to open the developer ejection opening 200*a* and thereby provide a channel for ejecting the waste developer from the developing unit 2 to the collecting container 300.

Figure 8:
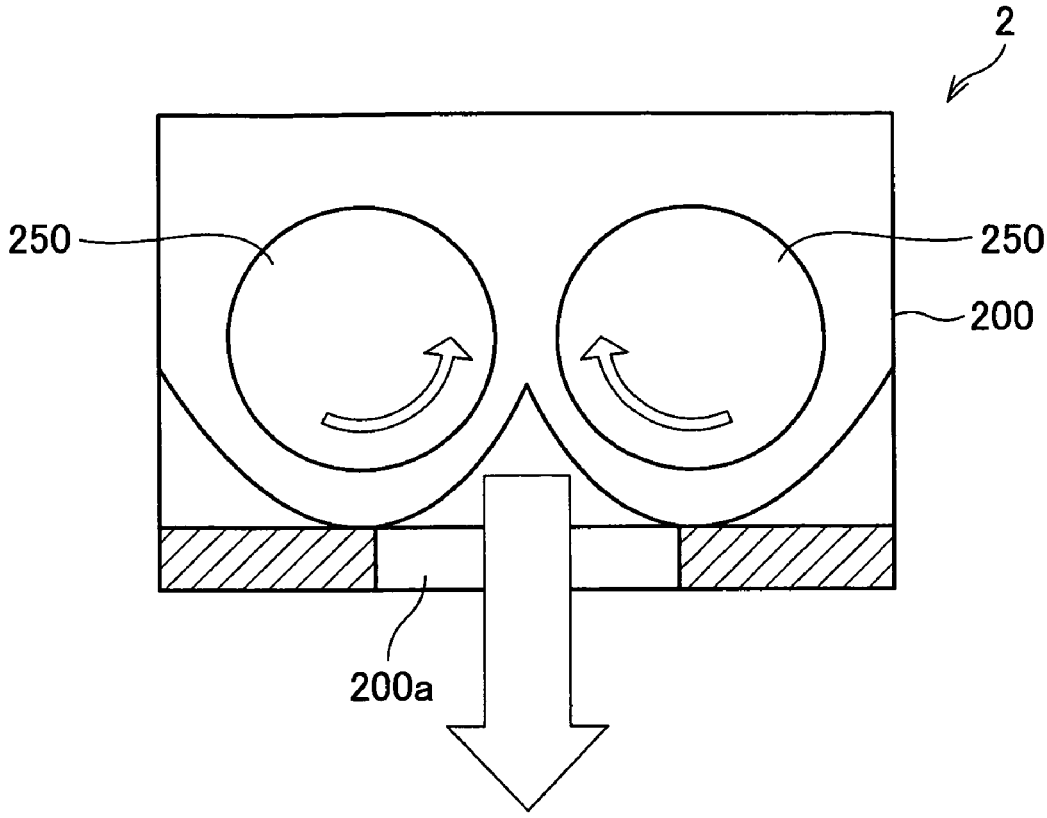
FIG. 8 is a cross sectional plan view illustrating an operation of the developing unit in ejecting and collecting the waste developer in the waste developer collecting device.

In this state, as shown in FIG. 8, the developing unit 2 is driven by itself (without supplying the developer to the photoreceptor drums 3*a* through 3*d*). Here, two screws 250 provided inside the developer tank of the developing unit 2 rotate in opposite directions to stir and circulate the developer inside the developer tank. The screws 250, provided as transport means, can be realized by, for example, screws as disclosed in Tokukaihei 6-89061. The developer transported and circulated by the screws 250 eventually reaches the bottom of the developing unit 2. The developer at the bottom of the developing unit 2 is ejected through the developer ejection opening 200a, and collected by the collecting container 300 by sliding on the ejection slope 221. This completes the ejection and collection procedures of the waster developer.

Figure 9:
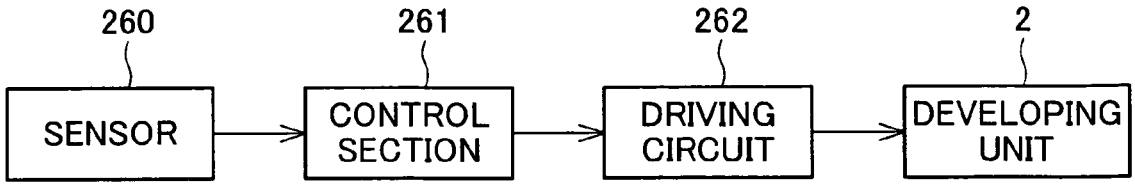
FIG. 9 is a block diagram illustrating a control system for automatically ejecting the waste developer in the waste developer collecting device.

In order to drive the developing unit 2 by itself, the screws 250 may be automatically rotated upon detecting that the developer ejection opening 200*a* is fully open. The control system used for this purpose is realized by a sensor 260, a control section 261, a driving circuit 262, and the developing unit 2, as shown in FIG. 9.

The sensor 260, provided as open-state detecting means, outputs a detection signal upon detecting that the developer ejection opening 200*a* is fully open. For example, the sensor 260 is an optical sensor including a photo emitter and a photo receptor. The photo emitter is provided either in the vicinity of the anterior portion of the developer ejection opening 200*a*, or in an arbitrarily selected portion on the opposing upper surface of the collecting container mount 220, while the photo receptor is provided on the other. With the ejection shutter 210 completely opening the developer ejection opening 200*a* as shown in FIG. 1, the optical sensor detects the fully opened state of the developer ejection opening 200*a* by detecting the emitted light of the photo emitter with the photo receptor. The result of detection is outputted by varying the output level from Low to High, for example.

The control section 261, provided as transport driving control means, may be realized, for example, with the use of the control unit for controlling the entire operation of the image forming apparatus 100, by using part of the control unit controlling the developing unit 2. Upon receiving the detection signal from the sensor 260, the control section 261 sends control instructions to the driving circuit 262, so as to drive a screw-driving motor (not shown) and thereby rotates only the screws 250.

With such a control system, the developing unit 2 is automatically driven by itself when a user draws the ejection shutter 210 to completely open the developer ejection opening 200*a*. As a result, the waste developer is ejected and collected automatically. Thus, the user is not required to perform the additional operation of driving the developing unit 2 by itself.

The developing device employing the two-component development system requires replacement and maintenance of the developer in order to ensure good image quality over predetermined print counts, owning to the fact that the carrier contained in the developer degrades with time. The replacement procedure involves ejecting and collecting the old developer and then replenishing a new developer in the empty developing device. Conventionally, the developer is manually ejected by first detaching the developing unit 2 from the image forming apparatus 100, and then removing the cover sealing the developing unit 2.

However, with the collecting container 300 attached to the developing unit 2, the foregoing procedure can be performed without detaching the developing unit 2 from the image forming apparatus 100. Further, the developer can be ejected by driving the developing unit 2 by itself, with the collecting container 300 attached to the developing unit 2. In this way, the developer can be replaced more efficiently and conveniently.

Further, in order to move the ejection shutter 210, a user is required to push the screw blocking member 400 into the depression 224*a* with the tongue 302, expose the head of the fixing screw 240, and remove the fixing screw 240. This prevents the developer from being accidentally ejected by error. Accordingly, there will be no scattering of developer around the image forming apparatus 100. Further, because the structure for pushing the screw blocking member 400 into the depression 224*a* and exposing the fixing screw 240 is realized by the tongue 302 provided on the collecting container 300, the developing unit 2 does not require an additional mechanism, such as a shutter, for exposing the fixing screw 240, yet can operate perfectly both structurally and functionally.

The following summarizes the present embodiment.

According to the present embodiment, there is provided a waste developer collecting device for ejecting and collecting a waste developer used in a developing unit employing a two-component developing system in which a developer that contains toner and carrier is used, the waste developer collecting device including: an opening and closing section for opening and closing a developer ejection opening formed on a bottom portion of the developing unit; an opening operation prohibiting section for prohibiting the opening operation of the opening and closing section; a collecting container for collecting the developer ejected through the developer ejection opening; and a collecting container fixing section for fixing the collecting container at a position where the developer ejected from the developing unit is collected, the opening operation prohibiting section allowing the opening operation of the opening and closing section when the collecting container is fixed by the collecting container fixing section.

As described above, the waste developer collecting device of the present embodiment is adapted so that the opening and closing section cannot open the developer ejection opening unless the collecting container is fixed on the collecting container fixing section. This prevents the developer from being ejected due to erroneous operation. By thus preventing the developer from spilling over the apparatus or its surroundings by mistake, operability of the waste developer collecting device can be improved.

It is preferable in the waste developer collecting device that he opening operation prohibiting section includes: a fixing section for fixing the opening and closing section with the developer ejection opening closed; and a fixing releasing/non-releasing section for preventing the fixing section from being released when the collecting container is not fixed by the collecting container fixing section, and for allowing the fixing section to be released when the collecting container is fixed by the collecting container fixing section.

According to this arrangement, the fixing releasing/non-releasing means prevents the fixing section from being released when the collecting container is not fixed on the collecting container fixing section. Thus, in this state, the opening and closing section closes the developer ejection opening by being fixed. On the contrary, with the collecting container fixed on the collecting container fixing section, the fixing releasing/non-releasing section allows the fixing section to be released. The user can then release the fixed state and open the opening and closing section. By this requiring the user to release the fixing section, an operation error can be prevented more reliably.

It is preferable in the waste developer collecting device that the collecting container has a container-side coupling portion, projecting in shape, for coupling to the collecting container fixing section, that the fixing section is a screw for fixing the opening and closing section on the collecting container fixing section, and that the fixing releasing/non-releasing section is a flexible member, provided behind a fixing-side coupling portion at which the container-side coupling portion is coupled to the collecting container fixing section, for blocking a head portion of the screw when the container-side coupling portion is not coupled to the fixing-side coupling portion, and for exposing the head portion of the screw by being pushed and deformed by the container-side coupling portion when the container-side coupling portion is coupled to the fixing-side coupling portion.

According to this arrangement, since the fixing section is realized by a screw, the fixed state can be released only by the simple procedure of removing the screw. Further, since the fixing releasing/non-releasing section is realized by a flexible member, a film made of, for example, polyethylene terephthalate can be used for the fixing releasing/non-releasing section. Thus, the fixing releasing/non-releasing section can be realized with a simple structure and at low cost.

It is preferable that the waste developer collecting device further includes: an opened state detecting section for detecting that the developer ejection opening has been opened by the opening and closing section; and a transport driving control section for driving, when the opened state detecting means has detected that the developer ejection opening is open, a transport section that transports the developer in the developing unit.

According to this structure, the transport driving control section drives the transport section when the opened state detecting section detects that the developer ejection opening has been opened by the opening and closing section. As a result, the developer transported to the developer ejection opening by the transport section is ejected through the developer ejection opening. Thus, a user is not required to perform the procedure of instructing the transport section to eject the developer. The user is also prevented from making a mistake in operating the device.

With the waste developer collecting device as structured above, an image forming apparatus of the present invention can collect the developer without errors. Meanwhile, in the tandem system employed in color copying machines for example, only a small space is reserved for the developing unit. This has called for miniaturization of the developing unit. With the waster developer collecting device, the developing unit of the tandem system will not require an additional mechanism (for example, a screw for ejecting the developer) for collecting the developer, or any modification of the existing mechanism. Rather, with the existing members such as the stirring roller and circulating roller, a developer replacement system can be realized that can accommodate smaller devices.

As described above, the waste developer collecting device is structured to allow for easy ejection and collection of the developer, and therefore can be suitably used as a mechanism for ejecting and collecting the waste developer in apparatuses such as a copying machine employing the two-component developing system in which toner and carrier are used according to the brush developing method, or image forming apparatuses employing the electrophotographic system, such as a laser printer or a facsimile machine.

The present invention is not limited to the description of the embodiments above, but may be altered by a skilled person within the scope of the claims. An embodiment based on a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A waste developer collecting device for ejecting and collecting a waste developer used in a developing unit employing a two-component developing system in which a developer that contains toner and carrier is used, said waste developer collecting device comprising:

opening and closing means for opening and closing a developer ejection opening formed on a bottom portion of the developing unit;

opening operation prohibiting means for prohibiting the opening operation of the opening and closing means;

a collecting container for collecting the developer ejected through the developer ejection opening; and collecting container fixing means, having a fixing-side coupling portion, for fixing the collecting container at a position where the developer ejected from the developing unit is collected, the opening operation prohibiting means allowing the opening operation of the opening and closing means when the collecting container is fixed by the collecting container fixing means, wherein the opening operation prohibiting means includes:

fixing means for fixing the opening and closing means with the developer ejection opening closed; and fixing releasing/non-releasing means for preventing the fixing means from being released when the collecting container is not fixed by the collecting container fixing means, and for allowing the fixing means to be released when the collecting container is fixed by the collecting container fixing means, wherein the collecting container has a container-side coupling portion, projecting in shape, for coupling to the collecting container fixing means, wherein the fixing means is a screw for fixing the opening and closing means of the collecting container fixing means, and wherein the fixing releasing/non-releasing means is a flexible member, provided behind the fixing-side coupling portion at which the container-side coupling portion is coupled to the collecting container fixing means, for blocking a head portion of the screw when the container-side coupling portion is not coupled to the fixing-side coupling portion, and for exposing the head portion of the screw by being pushed and deformed by the container-side coupling portion when the container-side coupling portion is coupled to the fixing-side coupling portion.

2. The waste developer collecting device as set forth in claim 1, further comprising:

opened state detecting means for detecting that the developer ejection opening has been opened by the opening and closing means; and transport driving control means for driving, when the opened state detecting means has detected that the developer ejection opening is open, transport means that transports the developer in the developing unit.

3. An image forming apparatus which includes a developing unit employing a two-component developing system in which a developer that contains toner and carrier is used, and a waste developer collecting device for ejecting and collecting a waste developer used in the developing unit, said image forming apparatus comprising:

opening and closing means for opening and closing a developer ejection opening formed on a bottom portion of the developing unit;

opening operation prohibiting means for prohibiting the opening operation of the opening and closing means;

a collecting container for collecting the developer ejected through the developer ejection opening; and collecting container fixing means, having a fixing side coupling portion, for fixing the collecting container at a position where the developer ejected from the developing unit is collected, the opening operation prohibiting means allowing the opening operation of the opening and closing means when the collecting container is fixed by the collecting container fixing means, wherein the opening operation prohibiting means includes:

fixing means for fixing the opening and closing means with the developer ejection opening closed; and fixing releasing/non-releasing means for preventing the fixing means from being released when the collecting container is not fixed by the collecting container fixing means, and for allowing the fixing means to be released when the collecting container is fixed by the collecting container fixing means, wherein the collecting container has a container-side coupling portion, projecting in shape, for coupling to the collecting container fixing means, wherein the fixing means is a screw for fixing the opening and closing means of the collecting container fixing means, and wherein the fixing releasing/non-releasing means is a flexible member, provided behind the fixing-side coupling portion at which the container-side coupling portion is coupled to the collecting container fixing means, for blocking a head portion of the screw when the container-side coupling portion is not coupled to the fixing-side coupling portion, and for exposing the head portion of the screw by being pushed and deformed by the container-side coupling portion when the container-side coupling portion is coupled to the fixing-side coupling portion.

4. The image forming apparatus as set forth in claim 1, further comprising:

opened state detecting means for detecting that the developer ejection opening has been opened by the opening and closing means; and transport driving control means for driving, when the opened state detecting means has detected that the developer ejection opening is open, transport means that transports the developer in the developing unit.

5. A waste developer collecting device for ejecting and collecting a waste developer used in a developing unit employing a two-component developing system in which a developer that contains toner and carrier is used, said waste developer collecting device comprising:

a shutter for opening and closing a developer ejection opening formed on a bottom portion of the developing unit;

opening operation stopper for prohibiting the opening operation of the shutter;

a collecting container for collecting the developer ejected through the developer ejection opening; and collecting container fixing section, having a fixing side coupling portion, for fixing the collecting container at a position where the developer ejected from the developing unit is collected, the opening operation stopper allowing the opening operation of the shutter when the collecting container is fixed by the collecting container fixing section, wherein the opening operation stopper includes:

fixing member for fixing the shutter with the developer ejection opening closed; and fixing preventing/allowing member for preventing the fixing member from being released when the collecting container is not fixed by the collecting container fixing section, and for allowing the fixing member to be released when the collecting container is fixed by the collecting container fixing section, wherein the collecting container has a container-side coupling portion, projecting in shape, for coupling to the collecting container fixing section, wherein the fixing member is a screw for fixing the shutter on the collecting container fixing section, and wherein the fixing preventing/allowing member is a flexible member, provided behind the fixing-side coupling portion at which the container-side coupling portion is coupled to the collecting container fixing section, for blocking a head portion of the screw when the container-side coupling portion is not coupled to the fixing-side coupling portion, and for exposing the head portion of the screw by being pushed and deformed by the container-side coupling portion when the container-side coupling portion is coupled to the fixing-side coupling portion.

6. The waste developer collecting device as set forth in claim 5, further comprising:

a detector for detecting that the developer ejection opening has been opened by the shutter; and a driving controller for driving, when the detector has detected that the developer ejection opening is open, a transport section that transports the developer in the developing unit.

7. An image forming apparatus which includes a developing unit employing a two-component developing system in which a developer that contains toner and carrier is used, and a waste developer collecting device for ejecting and collecting a waste developer used in the developing unit, said image forming apparatus comprising:

a shutter for opening and closing a developer ejection opening formed on a bottom portion of the developing unit;

opening operation stopper for prohibiting the opening operation of the shutter;

a collecting container for collecting the developer ejected through the developer ejection opening; and collecting container fixing section, having a fixing side coupling portion, for fixing the collecting container at a position where the developer ejected from the developing unit is collected, the opening operation stopper allowing the opening operation of the shutter when the collecting container is fixed by the collecting container fixing section, wherein the opening operation stopper includes:

fixing member for fixing the shutter with the developer ejection opening closed; and fixing preventing/allowing member for preventing the fixing member from being released when the collecting container is not fixed by the collecting container fixing section, and for allowing the fixing member to be released when the collecting container is fixed by the collecting container fixing section, wherein the collecting container has a container-side coupling portion, projecting in shape, for coupling to the collecting container fixing section, wherein the fixing member is a screw for fixing the shutter on the collecting container fixing section, and wherein the fixing preventing/allowing member is a flexible member, provided behind the fixing-side coupling portion at which the container-side coupling portion is coupled to the collecting container fixing section, for blocking a head portion of the screw when the container-side coupling portion is not coupled to the fixing-side coupling portion, and for exposing the head portion of the screw by being pushed and deformed by the container-side coupling portion when the container-side coupling portion is coupled to the fixing-side coupling portion.

8. The image forming apparatus as set forth in claim 7, further comprising:

a detector for detecting that the developer ejection opening has been opened by the shutter; and a driving controller for driving, when the detector has detected that the developer ejection opening is open, a transport section that transports the developer in the developing unit.

* * * * *